US006519780B2

(12) United States Patent
Goodwin

(10) Patent No.: US 6,519,780 B2
(45) Date of Patent: Feb. 18, 2003

(54) AIR-HOLDING PROTECTIVE FOAM PAD CONSTRUCTION

(76) Inventor: Edward L. Goodwin, 7 Hubbard St., Canton, MA (US) 02021

( * ) Notice: Subject to any disclaimer, the term of this patent is extended or adjusted under 35 U.S.C. 154(b) by 0 days.

(21) Appl. No.: 09/825,730

(22) Filed: Apr. 4, 2001

(65) Prior Publication Data

US 2002/0152545 A1 Oct. 24, 2002

(51) Int. Cl.[7] ..... A41D 27/26
(52) U.S. Cl. ..... 2/267
(58) Field of Search ..... 2/455, 459–467, 2/2.5, 267, 247–253, 911, 94, 22, 24, 164, 167

(56) References Cited

U.S. PATENT DOCUMENTS 4,486,901 A * 12/1984 Donzis ..... 2/455
4,657,003 A * 4/1987 Wirtz ..... 128/133
4,700,403 A * 10/1987 Vacanti ..... 2/455
4,848,364 A * 7/1989 Bosman ..... 128/849

* cited by examiner

*Primary Examiner*—John J. Calvert
*Assistant Examiner*—Tejash Patel

(57) ABSTRACT

An air-holding protective foam pad construction where open cell foam is enveloped in an air-holding cavity formed by top and bottom air-holding sheets. The foam is not attached to the top and bottom air-holding sheets and the sheets are totally and continuously sealed together around a narrow common perimeter. Upon potentially destructive impact, the open cell foam first absorbs some of the impact force, and secondly the air expelled from the foam bloats the air-holding cavity. The result of the latter is a redistribution of impact forces over a larger surface area, reducing the intensity of force at the site of initial impact. The pad construction thereby has a dual action attenuation of both absorbing and redistributing the intensity of an initial localized impact force.

1 Claim, 1 Drawing Sheet

AIR-HOLDING PROTECTIVE FOAM PAD CONSTRUCTION

FIELD OF INVENTION

This invention relates to a protective pad-to reduce impact forces to vulnerable structures. The construction is composed of an unattached open cell foam pad sealed into an air-holding compartment formed by top and bottom layers of air-holding sheets. The top and bottom sheets are totally sealed together around their periphery resulting in an air-holding envelope containing the loose inner foam pad. In actual application, a larger structure could consist of an array or cluster of these single compartment structures.

BACKGROUND OF INVENTION

This invention relates to an improved body part protective pad having a dual mechanism shock absorbing and shock redistributing air-holding soft foam pad. There are many protective devices taught in prior art of protective pad construction. Most prior art can be separated into absorbing soft materials, force redistributing hard shells, or a combination of the two. Soft material by itself is often required to have objectionable thickness at the point where it offers good protection. Alternately, force diverting hard shells can be very effective, but also uncomfortable to wear. Inventors are therefore led to focus on soft pads with both an absorbing and force-redistributing component. The encapsulated foam pad is one such device. Pads of this construction can offer good attenuation properties along with user comfort. This combination of effective protection in a comfortable pad construction provides for greater user acceptance and therefore less impact injuries in the population at large.

Prior art teaches foam enclosed in generally air impermeable pouches with channels or valves to expel air in the event of an impact. U.S. Pat. No. 4,486,901 teaches a generally impermeable membrane enclosing foam with apertures in communication with the atmosphere. U.S. Pat. No. 5,881,395 teaches a similar pad with air management holes. And U.S. Pat. No. 4,566,137 teaches an inflatable pad with interconnecting channels. These constructions are designed to redistribute impact forces by air movement to the atmosphere or other compartments. These prior art are improvements in protective padding. However, they are expensive because they are intricately designed and require high mold and tool investment to obtain the apertures or communicating channels. This expense limits the degree that the at-risk general population could benefit from these protective pads.

The present invention, requiring only one continuous seal around the periphery of a single foam pad filled envelope, greatly reduces the expense of an air management protective pad. In this construction, the air attenuation properties of the pad are all internal to the single foam filled envelope. Upon impact to the pad, the air pushed out of the foam bloats the air-holding envelope and thereby redistributes the force to a surface area much larger than the point of impact. The force per square inch is thus averaged over a larger surface, often involving less vulnerable parts such as compliant muscle and fat (as opposed to non-compliant bone).

The present invention has been tested at university orthopedic biomechanical laboratories in relation to a hip pad protector application. At the Tampere University (Finland) orthopedic laboratories a surrogate pelvis has been constructed to test the attenuation of protective pads. The present invention, in a 12.7 mm construction proved to offer much better attenuation than much thicker soft pads (20 mm) and thicker hard shells. In this application, one construction of the current invention reduces the force at the point of impact to the artificial hip bone and redistributes much of the force to the surrounding surrogate soft tissue. In this theoretical model the force is reduced well below the fracture threshold by the present invention. The simplicity, low cost, soft comfort, and effective protection of the present invention are an improvement over the prior art in protective pads.

SUMMARY OF THE INVENTION

The present invention provides an improved body protective pad. It consists of an air-holding compartment containing an unattached open cell foam pad. Top and bottom air-holding sheets are completely and continuously sealed together around perimeter forming a compartment totally enveloping the open cell foam pad. The open cell foam core is not attached to the top and bottom sheets.

BRIEF DESCRIPTION OF THE DRAWING

The drawing is a cross section of the air-holding open cell foam pad construction, which could be round, oval, square, or asymmetrical in two dimensions while comparatively flat in it's third dimension.

DETAILED DESCRIPTION OF PREFERRED EMBODIMENT

Figure 1:
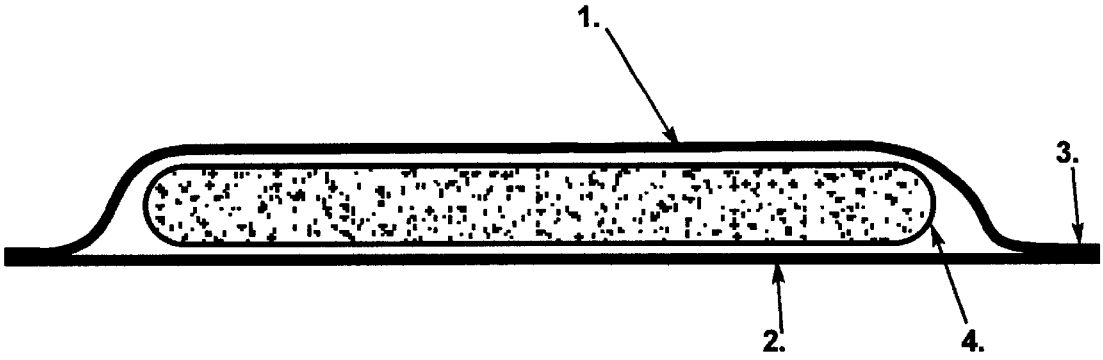

With reference to the cross sectional drawing , the air-holding pad consists of a top sheet 1, adhered completely and continuously to a bottom sheet 2, around a common narrow perimeter 3. These top and bottom air-holding sheets form a completely sealed compartment enclosing an unattached open cell foam pad 4. This basic unit of construction could be incorporated into a cluster or array in a larger protective pad.

What is claimed as being new and desired to be protected by Letters Patent of the United States is as follows:

1. An air-holding protective pad comprising:

an unattached open cell foam pad in a noncompressed state, including top and bottom air-holding sheets, where the top and bottom air-holding sheets are completely and continuously sealed around their common perimeter by forming an air-holding envelope, the foam pad positioned within the envelope;

wherein a force of impact imposed at a point on the unattached foam pad will cause the envelope to bloat, by redistributing the force to a surface area much larger than the point of impact.

* * * * *